US008678356B2

(12) United States Patent
Iwaki et al.

(10) Patent No.: US 8,678,356 B2
(45) Date of Patent: Mar. 25, 2014

(54) MICROBUBBLE GENERATING APPARATUS AND METHOD

(75) Inventors: Chikako Iwaki, Kamakura (JP); Kazuyoshi Aoki, Yokohama (JP); Hideo Komita, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 775 days.

(21) Appl. No.: 12/601,123

(22) PCT Filed: May 22, 2008

(86) PCT No.: PCT/JP2008/059448

§ 371 (c)(1),
(2), (4) Date: May 10, 2010

(87) PCT Pub. No.: WO2008/143319

PCT Pub. Date: Nov. 27, 2008

(65) Prior Publication Data

US 2010/0258509 A1 Oct. 14, 2010

(30) Foreign Application Priority Data

May 22, 2007 (JP) ..... 2007-135126

(51) Int. Cl.
*B01F 3/04* (2006.01)

(52) U.S. Cl.
USPC ..... 261/87; 261/93

(58) Field of Classification Search
USPC ..... 261/87, 91, 93
See application file for complete search history.

(56) References Cited

U.S. PATENT DOCUMENTS

| | | | | | |
|---|---|---|---|---|---|
| 1,031,666 | A | * | 7/1912 | Richmond | 366/265 |
| 2,673,724 | A | * | 3/1954 | Potts | 261/87 |
| 3,650,513 | A | * | 3/1972 | Werner | 261/87 |
| 3,911,064 | A | * | 10/1975 | McWhirter et al. | 261/87 |
| 3,917,763 | A | * | 11/1975 | Schafer | 261/87 |
| 4,231,974 | A | * | 11/1980 | Engelbrecht et al. | 261/87 |
| 4,290,885 | A | * | 9/1981 | Kwak | 210/197 |
| 4,465,645 | A | * | 8/1984 | Kaelin | 261/87 |

(Continued)

FOREIGN PATENT DOCUMENTS

| | | |
|---|---|---|
| JP | 37-10879 | 5/1962 |
| JP | 8-225094 | 9/1996 |

(Continued)

OTHER PUBLICATIONS

Second Notification of Reason for Rejection issued by the Chinese Patent Office on Sep. 20, 2012, for Chinese Patent Application No. 200880016867.9, and English-language translation thereof.

(Continued)

*Primary Examiner* — Charles Bushey
(74) *Attorney, Agent, or Firm* — Finnegan, Henderson, Farabow, Garrett & Dunner, L.L.P.

(57) ABSTRACT

There is provided a microbubble generating method including: supplying a gas to a rotator 2 while rotating the rotator 2 in a liquid; injecting the gas into the liquid from bubble injection holes formed in the surface of the rotator 2; and applying a shear force, produced by the relative movement between the liquid and the rotator, to gas bubbles present on and in the vicinity of the surface of the rotator 2 to generate microbubbles. The microbubble generating method can easily generate a large amount of microbubbles without forcibly creating a swirling flow of fluid.

3 Claims, 9 Drawing Sheets

(56) References Cited

U.S. PATENT DOCUMENTS

| | | | | |
|---|---|---|---|---|
| 4,611,790 | A * | 9/1986 | Otsuka et al. | 266/235 |
| 4,818,445 | A * | 4/1989 | Onizuka et al. | 261/87 |
| 6,382,601 | B1 | 5/2002 | Ohnari | |
| 2002/0070467 | A1 * | 6/2002 | Sherman | 261/87 |
| 2004/0217493 | A1 * | 11/2004 | Sperber et al. | 261/93 |

FOREIGN PATENT DOCUMENTS

| | | |
|---|---|---|
| JP | 52-108370 | 9/1997 |
| JP | 2000-107792 | 4/2000 |
| JP | 2003-205228 | 7/2003 |
| JP | 2007-268376 | 10/2007 |

OTHER PUBLICATIONS

Notification of Reason for Rejection issued by the Taiwanese Patent Office on Jul. 20, 2011, for Taiwanese Patent Application No. 97118965, and English-language translation thereof.

Office Action issued by the Korean Patent Office on Sep. 2, 2011, for Korean Patent Application No. 2009-7025881, and English-language translation thereof.

International Search Report from Japan in International Application No. PCT/CN2008/059448 mailed Jul. 15, 2008

International Preliminary Report on Patentability and Written Opinion issued by the International Bureau of WIPO on Jan. 21, 2010, for International Application No. PCT/JP2008/059448.

* cited by examiner

MICROBUBBLE GENERATING APPARATUS AND METHOD

TECHNICAL FIELD

The present invention relates to a microbubble generating apparatus and method, and more particularly to a microbubble generating apparatus and method capable of efficiently generating a large amount of microbubbles having a bubble diameter on the order of tens of μm.

BACKGROUND ART

So-called microbubbles having a bubble diameter on the order of 100 μm, because of their large body surface area and long residence time in a liquid as compared to bubbles of ordinary size, are expected to be used in a variety of applications where the physical/chemical characteristics of microbubbles are utilized, including a chemical reaction or transportation of a material at a gas-liquid interface.

Microbubble generating apparatuses generally use a method comprising blowing a gas through a porous body into a liquid.

Among such microbubble generating apparatuses, there is an apparatus which generates microbubbles by supplying a gas from a gas supply device, such as a compressor, through a porous body into a pipe in which water is flowing (see e.g. Japanese Patent Laid-Open Publication No. H8-225094, patent document 1).

Recently developed microbubble generating apparatuses often use a method comprising applying a shear force to the surfaces of bubbles to tear the bubbles apart.

Among such microbubble generating apparatuses, there is a swirling-type microbubble generating apparatus comprising a container body having a conical space, a pressurized liquid introduction inlet tangentially provided on the inner circumferential surface of the container, a gas introduction hole provided in the bottom of the conical space, and a swirling gas-liquid outlet provided at the top of the conical space (see e.g. Japanese Patent Laid-Open Publication No. 2003-205228, patent document 2).

DISCLOSURE OF THE INVENTION

The microbubble generating apparatus using a porous body, described in the patent document 1, involves the problem that gas bubbles are hard to release from the porous body, and therefore gas bubbles generated become larger than the pore size of the porous body, that is, fine gas bubbles cannot be generated. A technique of rotating a porous body is known. In this method, however, coarse bubbles will be generated in the vicinity of the axis of rotation where the bubbles are little influenced by the rotation. Therefore, the smallest possible diameter of gas bubbles generated under optimum conditions is about 0.4 mm.

On the other hand, the microbubble generating apparatus of the patent document 2, because of the application of a shear force to the surfaces of gas bubbles, can generate finer gas bubbles. In this apparatus a pressurized liquid is supplied into the conical container body in order to forcibly create a swirling flow of fluid. The apparatus thus entails the problem of a considerable pressure loss and, in addition, the problem of a low proportion of gas in liquid as compared to the case of using a porous body.

It is therefore an object of the present invention to solve the above problems in the prior art and provide a microbubble generating apparatus and method which can easily generate a large amount of microbubbles without forcibly creating a swirling flow of fluid.

It is another object of the present invention to provide a microbubble generating apparatus and method which, besides being capable of easily generating a large amount of microbubbles, can make the diameters of microbubbles more uniform or can generate gas bubbles having a smaller diameter.

In order to achieve the objects, the present invention provides a microbubble generating apparatus comprising: a bubble injection section, having a rotator supported rotatably in a liquid, for injecting a gas from the surface of the rotator into the liquid; a gas supply tube for supplying the gas as a material for gas bubbles to the bubble injection section; and a rotary drive device for rotating the bubble injection section in the liquid.

The present invention also provides a microbubble generating apparatus comprising: a bubble injection section, comprised of a rotator that rotates in a liquid, for injecting a gas from the surface of the rotator into the liquid and applying a shear force, produced by a relative movement between the liquid and the rotator, to gas bubbles present on and in the vicinity of the surface of the rotator to generate microbubbles; a gas supply tube for supplying the gas as a material for gas bubbles to the bubble injection section; and a rotary drive device for rotating the bubble injection section in the liquid.

In a preferred embodiment of the present invention, the bubble injection section is comprised of a rotator having small-diameter holes which serve as passages for the gas, or a rotator having, in its peripheral portion, small-diameter nozzles for emitting the gas. The rotator may be comprised of a porous body.

In a preferred embodiment of the present invention, the rotary drive device for rotating the bubble injection section has a control means for variably controlling the rotating speed of the bubble injection section.

The microbubble generating apparatus of the present invention may further comprise a collision plate, provided above the bubble injection section, which rotates in synchronization with the rotator and, in addition, comprise a bubble breakup section provided peripherally between the rotator of the bubble injection section and the collision plate.

The apparatus of the present invention may further comprise a baffle plate, which may be a vibrating baffle plate, provided above the bubble injection section. A porous cover, covering the bubble injection section, may also be provided.

The present invention also provides a microbubble generating method comprising: supplying a gas to a rotator while rotating the rotator in a liquid; injecting the gas into the liquid from bubble injection holes formed in the surface of the rotator; and applying a shear force, produced by the relative movement between the liquid and the rotator, to gas bubbles present on and in the vicinity of the surface of the rotator to generate microbubbles.

In the microbubble generating method, the rotating speed of the rotator may be varied in the range of not more than 6 m/s in terms of the peripheral speed of the bubble injection holes of the rotator in order to adjust the sizes or diameters of the gas bubbles generated. Alternatively, the rotating speed of the rotator may be set in the range of not less than 6 m/s in terms of the peripheral speed of the bubble injection holes of the rotator in order to equalize the diameters of the gas bubbles generated.

According to the present invention, a large amount of microbubbles can be easily generated without forcibly creating a swirling flow of fluid. In addition, the diameters of microbubbles can be made more uniform, or gas bubbles having a smaller diameter can be produced. The present invention can be applied e.g. in a decontamination apparatus in which microbubbles of ozone are injected into water in the shroud of a boiling-water reactor to dissolve and remove an oxide, or in a water or sewage treatment facility in which microbubbles of ozone are blown into a water (sewage) treatment tank to decompose organic matter.

BEST MODE FOR CARRYING OUT THE INVENTION

Preferred embodiments of the microbubble generating apparatus of the present invention will now be described with reference to the drawings.

<First Embodiment>

Figure 1:
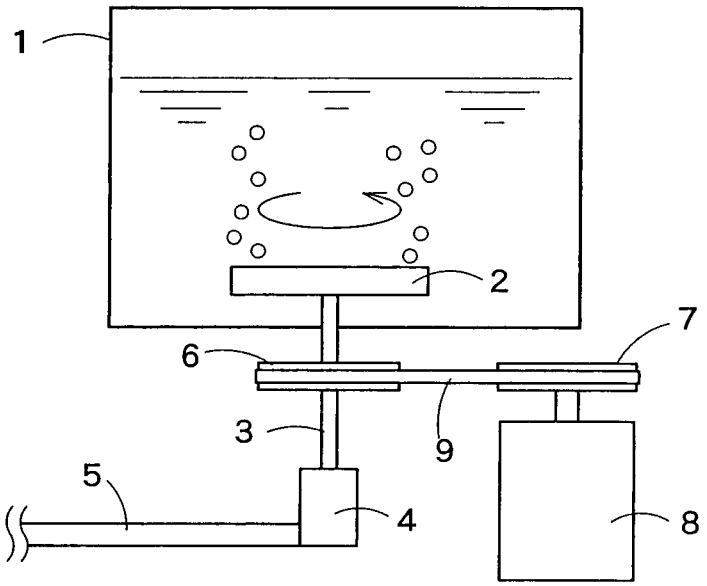
FIG. 1 is a diagram illustrating the construction of a microbubble generating apparatus according to a first embodiment of the present invention.

FIG. 1 shows a microbubble generating apparatus according to a first embodiment of the present invention.

In FIG. 1, reference numeral 1 denotes a tank filled with a liquid, for example, water. A bubble injection section 2, comprised of a rotator, is disposed in the liquid in the tank 1. To the bubble injection section 2 is coupled a rotating shaft 3 supported by a not-shown bearing. The end of the rotating shaft 3 is connected to a swivel joint 4. A gas supply tube 5 is connected to the swivel joint 4, so that a gas fed from the gas supply tube 5 passes through the swivel joint 4 and the rotating shaft 3, and is supplied to the bubble injection section 2. Numerous small holes are formed in the bubble injection section 2, and the gas is injected from the small holes into the liquid in the tank 1.

A driven pulley 6 is mounted to the rotating shaft 3, and a driving pulley 7 is attached to the drive shaft of a motor 8. A timing belt 9 is wound around the driving pulley 7 and the driven pulley 6.

The operation and the technical effects of the microbubble generating apparatus of this embodiment, having the above-described construction, will now be described.

When the gas is supplied from the gas supply tube 5 to the bubble injection section 2, gas bubbles are generated from the bubble injection section 2. While the bubble injection section 2 remains stationary in the liquid in the tank 1, the gas bubbles generated have a relatively large diameter.

When the motor 8 is driven and the rotation of the motor 8 is transmitted via the pulleys 7, 6 to the rotating shaft 3, the rotator, constituting the bubble injection section 2, rotates at a predetermined rotating speed.

A shear force, produced by the relative movement between the rotating bubble injection section 2 and the liquid, is applied to gas bubbles which have come out of the small holes and exist on and in the vicinity of the surface of the bubble injection section 2. The gas bubbles are torn apart by the shear force into microbubbles having a smaller diameter.

As described above, in this embodiment a shear force, which is necessary to make gas bubbles smaller, is produced by rotating the bubble injection section 2 while allowing the liquid to remain stationary. This eliminates the need to create a swirling flow of the liquid as in the conventional apparatus, making it possible to generate a larger amount of microbubbles.

Figure 2:
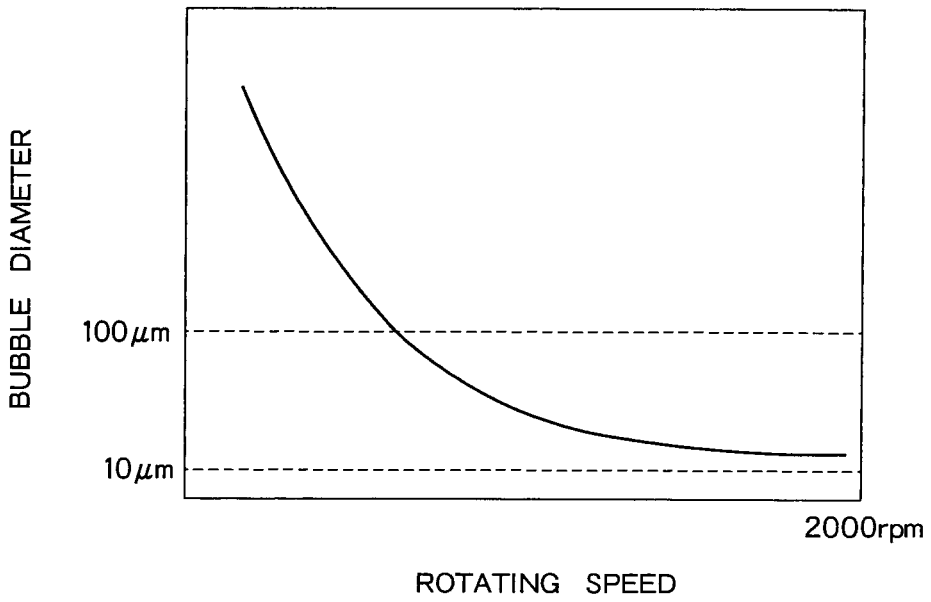
FIG. 2 is a graph showing the relationship between the rotating speed of a bubble injection section and the diameter of gas bubbles in the microbubble generating apparatus.

FIG. 2 is a graph showing change in the diameter of gas bubbles as the rotating speed of the bubble injection section 2 is changed by controlling the number of rotations of the motor 8 by a not-shown control device, such as an inverter, in the microbubble generating apparatus shown in FIG. 1.

When the bubble injection section 2 is rotating, gas bubbles injected into the liquid are subjected to a shear force applied by the surrounding liquid and are thereby torn apart. The shear force increases with an increase in the rotating speed of the bubble injection section 2 irrespective of the diameter of the holes of the bubble injection section 2. Accordingly, as shown in FIG. 2, the diameter of gas bubbles can be made smaller by controlling and increasing the number of rotations of the motor 8. Further, gas bubbles generated can be easily brought into a desired diameter by determining, like the data of FIG. 2, the relationship between the number of rotations of the motor and the diameter of gas bubbles in advance.

Figure 3:
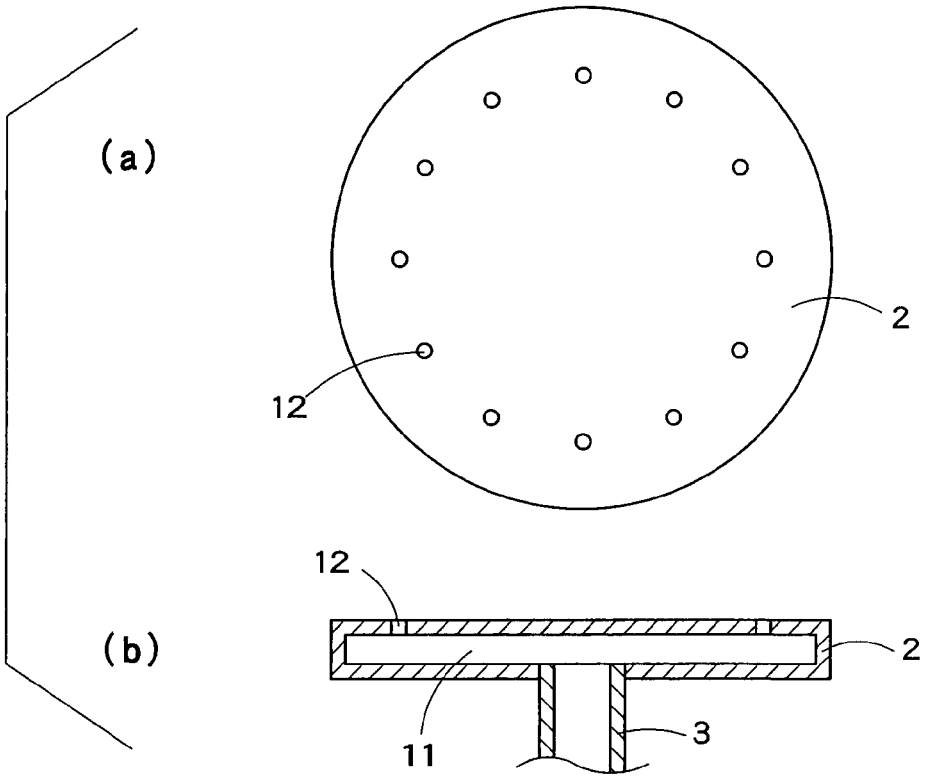
FIG. 3 shows the construction of a bubble injection section for use in the microbubble generating apparatus according to the present invention, FIG. 3(*a*) being a plan view and FIG. 3(*b*) a cross-sectional view.

FIG. 3 shows an example of the bubble injection section 2 for use in the microbubble generating apparatus according to the first embodiment of the present invention; FIG. 3(*a*) is a plan view and FIG. 3(*b*) is a cross-sectional view of the bubble injection section 2.

A hollow circular plate, having a cavity 11 in its interior, is used as the bubble injection section 2. A large number of bubble injection holes 12, having the same small diameter and formed in a circular arrangement at a predetermined pitch, open onto the upper surface of the circular plate.

The use of the bubble injection section 2, having such a construction, in the microbubble generating apparatus shown in FIG. 1 produces the following technical effects:

Gas bubbles are continually injected into the liquid in the tank 1 from the small-diameter bubble injection holes 12 opening onto the upper surface of the bubble injection section 2. Because the bubble injection section 2 is driven by the motor 8 and is rotating at a predetermined rotating speed, a shear force, determined by the centrifugal force, acts on the gas bubbles whereby the gas bubbles become smaller.

According to the microbubble generating apparatus of this embodiment, because of the circular arrangement of the bubble injection holes 12 in the bubble injection section 2, a constant shear force can be applied to gas bubbles. This makes it possible to equalize the diameters of gas bubbles generated. Further, it becomes possible to set a varying degree of shear force by changing the radius of the circle along which the holes 12 are arranged.

<Second Embodiment>

A second embodiment of the present invention will now be described with reference to FIGS. 4 through 9.

Figure 4:
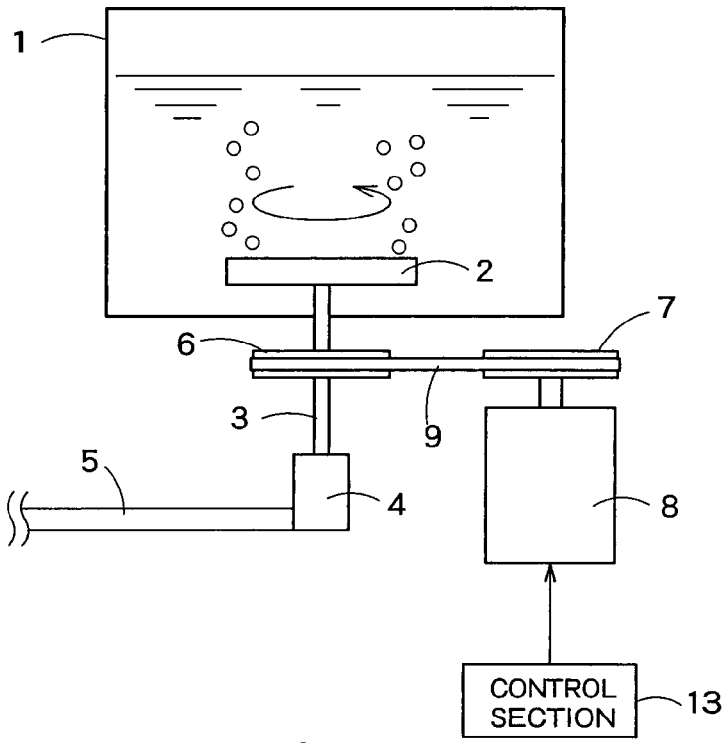
FIG. 4 is a diagram illustrating the construction of a microbubble generating apparatus according to a second embodiment of the present invention.
Figure 5:
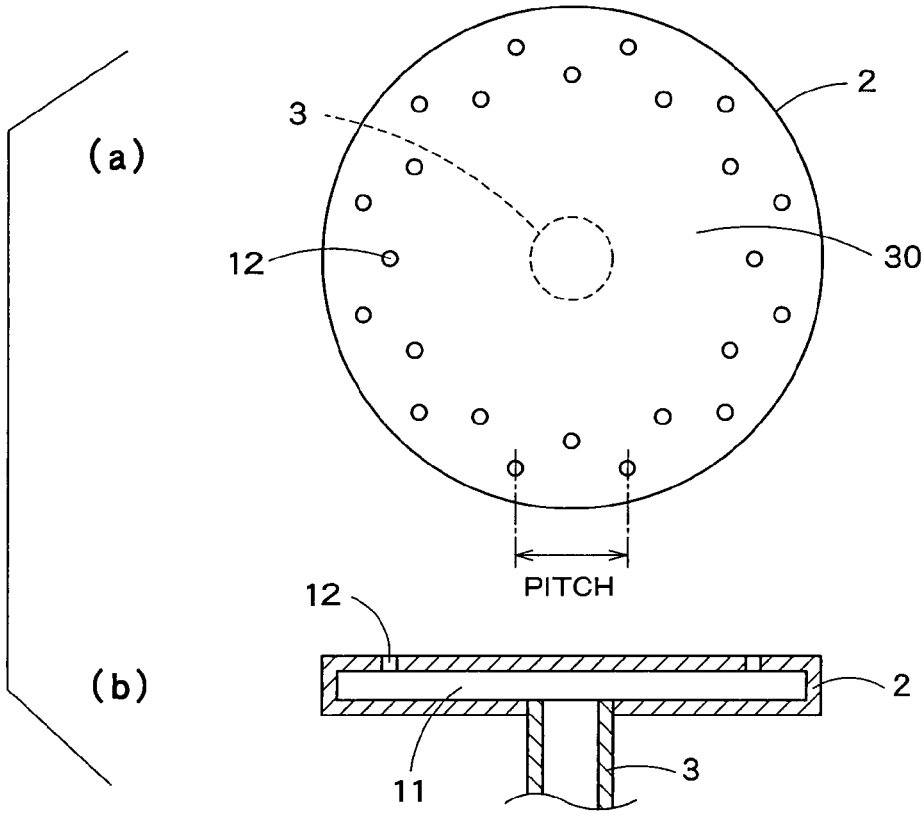
FIG. 5 shows the construction of a bubble injection section for use in the microbubble generating apparatus according to the second embodiment of the present invention, FIG. 5(*a*) being a plan view and FIG. 5(*b*) a cross-sectional view.

In the second embodiment, as shown in FIG. 4, the microbubble generating apparatus of FIG. 1 is provided with a control section 13 for precisely controlling the number of rotations of the motor 8 and, as shown in FIG. 5, a bubble injection section 2, having bubble injection holes 12 formed in a different arrangement, is provided. The other components are the same as the microbubble generating apparatus of FIG. 1; the same components are given the same reference numerals and a detailed description thereof will be omitted.

As with the first embodiment, a hollow circular plate, having a cavity 11 in its interior, is used as the bubble injection section 2 as shown in FIG. 5. Bubble injection holes 12, arranged at a given pitch, open onto the upper surface of the circular plate. The bubble injection holes 12 are formed in a region near the periphery of the bubble injection section 2 and not formed in a region 30 around the center.

A description will now be made of the operation of the microbubble generating apparatus thus constructed and of a microbubble generating method carried out by means of the apparatus.

When gas bubbles are injected into a liquid from the bubble injection holes 12 of the bubble injection section 2, the diameter of the gas bubbles changes by the action of a shear force applied from the surrounding liquid. The shear force increases with an increase in the rotating speed of the bubble injection section 2, i.e. with an increase in the peripheral speed of the bubble injection holes 12, and the diameter of gas bubbles decreases with the increase in the shear force.

Figure 6:
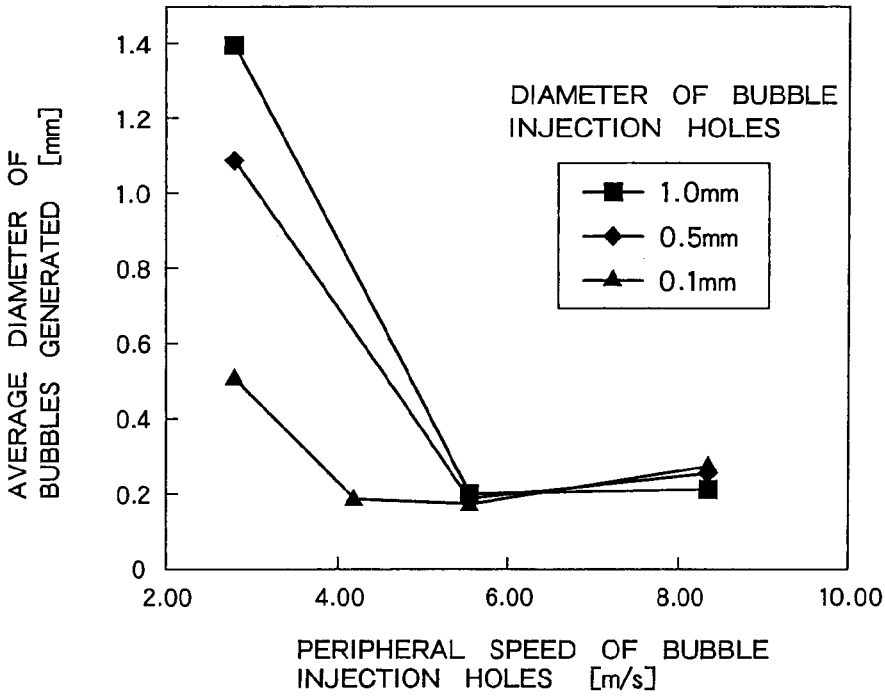
FIG. 6 is a graph showing the relationship between the peripheral speed of bubble injection holes and the average diameter of gas bubbles generated in the second embodiment of the present invention.

This has been verified by an experiment conducted using a small-scale test apparatus (gas flow rate: 0.2 liter/min), the results of which are shown in FIG. 6. The data in FIG. 6 shows a remarkable difference in the average diameter of gas bubbles, with the peripheral speed of the bubble injection holes 12 of 6 m/s as the boundary.

As can be seen from the data, when the peripheral speed of the bubble injection holes 12 is in the range of not more than m/s, the average diameter of gas bubbles generated decreases with an increase in the peripheral speed. By utilizing this characteristic, and varying the rotating speed of the bubble injection section 2 by varying the number of rotations of the motor 8 by means of the control section 13, it becomes possible to vary the diameter of gas bubbles generated. Thus, the diameter of gas bubbles can be adjusted to a desired diameter by controlling the number of rotations of the motor 8 such as to provide the peripheral speed which falls in the range of not more than 6 m/s and corresponds to the desired bubble diameter.

On the other hand, when the peripheral speed of the bubble injection holes 12 is in the range of not less than 6 m/s, the average diameter of gas bubbles generated is constant at about 0.2 mm despite change in the peripheral speed of the bubble injection section 2. By utilizing this characteristic, it becomes possible to generate uniform gas bubbles as described below.

The peripheral speed of the bubble injection holes 12 is the product of the angular velocity of the rotation of the bubble injection section 2 and the distance between the rotating shaft 3 and the bubble injection holes 12. Thus, the peripheral speed can be made not less than 6 m/s for all the bubble injection holes 12 by setting the angular velocity of the rotation of the bubble injection section 2 and the position(s) of the bubble injection hole(s) 12 whose distance to the rotating shaft 3 is the shortest in such a manner as to make the peripheral speed of the bubble injection hole(s) 12 not less than 6 m/s. Therefore, by rotating the bubble injection section 2 under such conditions, the average diameter of gas bubbles generated from all the gas injection holes 12 can be made about 0.2 mm. It thus becomes possible to generate uniform gas bubbles with a narrow bubble diameter distribution from the bubble injection section 2.

FIG. 6 also shows the relationship between the diameter of the bubble injection holes 12 and the average diameter of gas bubbles generated, determined by the experiment. As can be seen from the data in FIG. 6, when the peripheral speed is in the range of not more than 6 m/s, the average diameter of gas bubbles generated decreases with the decrease in the diameter of the bubble injection holes 12, whereas when the peripheral speed is in the range of not less than 6 m/s and the diameter of the bubble injection holes 12 is in the tested range of 0.1 mm to 1.0 mm, the average diameter of gas bubbles generated is constant at about 0.2 mm without being influenced by the diameter of the bubble injection holes 12. This indicates that the diameter of the bubble injection holes 12 need not necessarily be made small in order to generate fine bubbles. By utilizing this characteristic and using the peripheral speed of not less than 6 m/s, it becomes possible to generate gas bubbles having a diameter of about 0.2 mm even when the bubble injection holes 12 having a diameter of 1.0 mm, which are large for the microbubble generating apparatus, are used. The use of large bubble injection holes 12 can reduce the pressure loss at the holes, thus enabling reduction in the power of a blower or a compressor for use in bubble injection.

Figure 7:
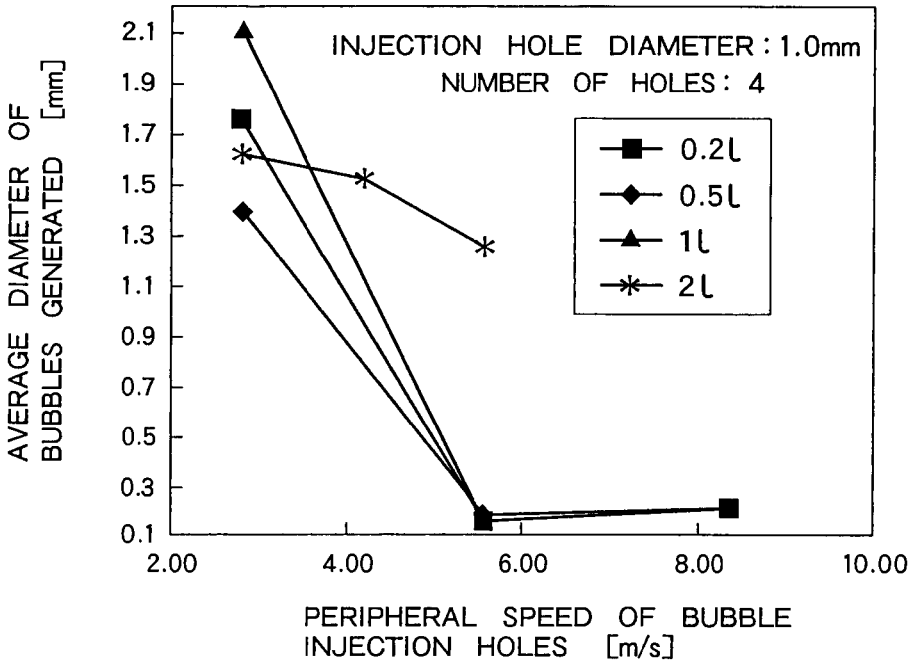
FIG. 7 is a graph showing the relationship between the peripheral speed of bubble injection holes and the average diameter of gas bubbles generated, as observed when the gas flow rate is varied, in the second embodiment of the present invention.

FIG. 7 shows the relationship between the peripheral speed of bubble injection holes 12 having a diameter of 0.1 mm and the average diameter of gas bubbles generated, as observed when the number of the holes 12 is four and the gas flow rate is varied. The data indicates that when such a high gas flow rate as 2 liter/min is used, microbubbles cannot be generated even with the use of a high peripheral speed of holes 12. It thus turns out that in this case the gas flow rate must be made lower than the limit value 2 liter/min in order to generate microbubbles.

Figure 8:
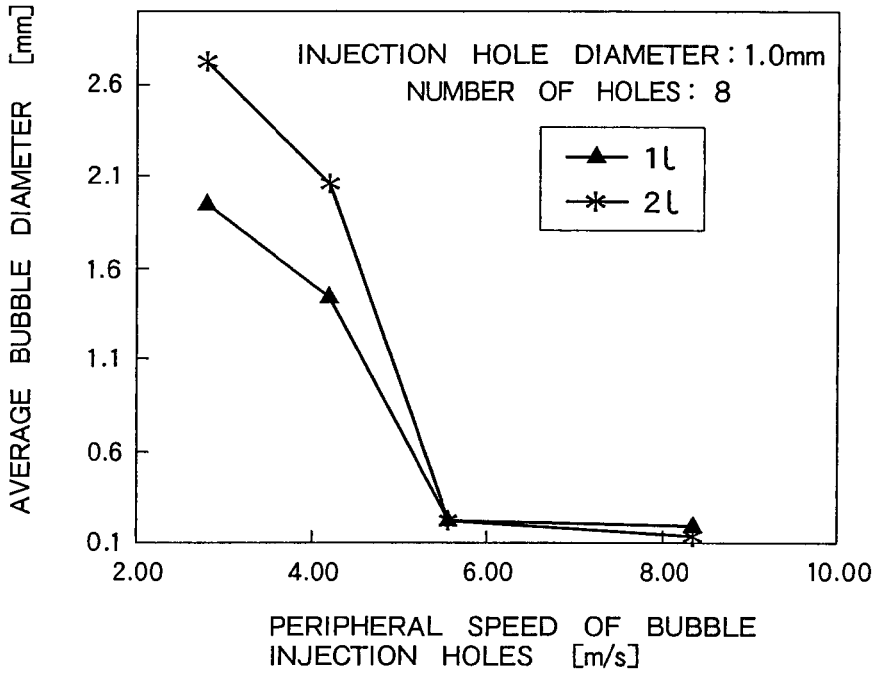
FIG. 8 is a graph showing the relationship between the peripheral speed of bubble injection holes and the average diameter of gas bubbles generated, as observed when the number of bubble injection holes is increased, in the second embodiment of the present invention.

FIG. 8 shows the relationship between the peripheral speed of bubble injection holes 12 having a diameter of 0.1 mm and the average diameter of gas bubbles generated, as observed when the number of the holes 12 is increased to eight and the gas flow rate is varied. The data indicates that the increase in the number of holes 12 makes it possible to generate microbubbles at the gas flow rate of 2 liter/min at which microbubbles cannot be generated when the number of holes 12 is four. It turns out from the comparative data that increasing the number of bubble injection holes 12 makes it possible to increase the limit value of gas flow rate while maintaining a small bubble diameter.

Figure 9:
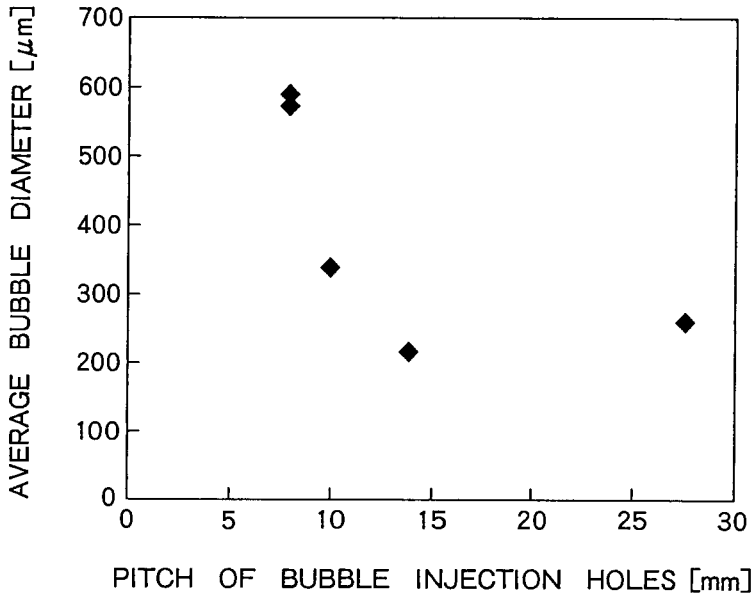
FIG. 9 is a graph showing the relationship between the pitch of bubble injection holes and the average diameter of gas bubbles generated in the second embodiment of the present invention.

FIG. 9 shows the relationship between the pitch of bubble injection holes and the average diameter of gas bubbles generated. As can be seen from the data, the use of a pitch of not more than 10 mm for bubble injection holes leads to a significant increase in the average diameter of gas bubbles generated.

The present invention, which can effectively generate microbubbles as described above, can be used in a variety of applications.

For instance, the present invention can be used in a decontamination apparatus in which microbubbles of ozone are injected into water in the shroud of a boiling-water reactor (BWR) to dissolve and remove an oxide. In this case, a microbubble generating apparatus may be installed in the bottom of the shroud. By supplying ozone to the microbubble generating apparatus and feeding microbubbles into the shroud by means of a jet pump, contaminants, such as a chrome oxide, produced on the wall surface of the shroud can be dissolved and efficiently removed. Because the microbubble generating apparatus can efficiently inject microbubbles of ozone into water, those portions which can hardly be reached by large bubbles can be cleaned by utilizing the flow of the jet pump. In the case of an advanced boiling light-water-cooled reactor (ABWR), microbubbles may be fed to the entire shroud by using an internal pump in combination.

In another application of the present invention, a microbubble generating apparatus can be installed in a water treatment tank. Microbubbles of ozone are blown into water in the water treatment tank to decompose organic matter with the microbubbles, thereby purifying the water. Alternatively, a microbubble generating apparatus can be installed in a sewage treatment tank. By blowing microbubbles of air into sewage in the treatment tank, oxygen can be supplied in an amount sufficient for the multiplication of microorganisms that purify the sewage.

It is also possible to install a microbubble generating apparatus in a washing machine. The cleaning effect can be increased by blowing microbubbles into the washing machine upon washing.

Application of the present invention is not limited to artificial tanks. For example, a microbubble generating apparatus according to the present invention may be used in an aquafarm located in a cove, river or lake to sufficiently supply oxygen to water or seawater.

Another example of the bubble injection section 2 for use in the microbubble generating apparatus of FIG. 4 according to the second embodiment of the present invention will now be described with reference to FIG. 10.

Figure 10:
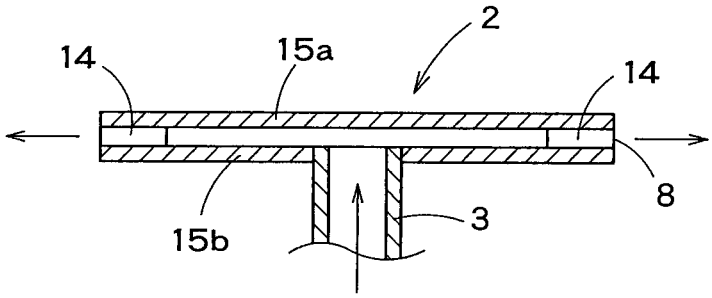
FIG. 10 is a cross-sectional diagram showing the construction of another bubble injection section for use in the microbubble generating apparatus according to the second embodiment of the present invention.

FIG. 10 shows a rotator constituting the bubble injection section 2. Unlike the bubble injection section 2 shown in FIG. 5, the bubble injection section 2 shown in FIG. 10 does not have injection holes in its upper surface, but instead has a plurality of radially-directed small-diameter nozzles 14 in its peripheral portion. The bubble injection section 2 comprises an upper disk 15*a* and a lower disk 15*b*, with the small-diameter nozzles 14 being sandwiched between the disks 15*a*, 15*b*.

According to the bubble injection section 2 having the small-diameter nozzles 14, a shear force, determined by centrifugal force, acts on gas bubbles coming out of the small-diameter nozzles 14, whereby the gas bubbles are made smaller. Because the outlets of the small-diameter nozzles 14 are located along the circumference of the bubble injection section 2, a constant shear force can be applied to gas bubbles. This makes it possible to equalize the diameters of gas bubbles generated.

Figure 11:
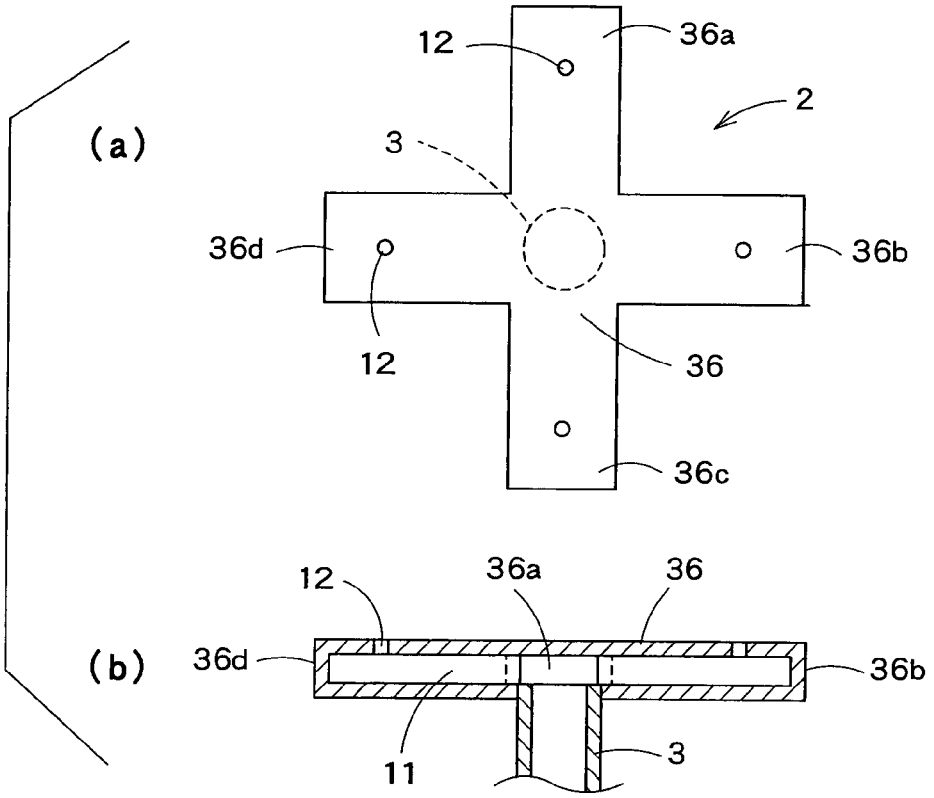
FIG. 11 shows the construction of another microbubble generating apparatus according to the second embodiment of the present invention.

FIG. 11 shows yet another example of the bubble injection section 2 for use in the microbubble generating apparatus of FIG. 4.

The bubble injection section 2 for use in the microbubble generating apparatus is not limited to a disk-shaped rotator, but a rotator having a polygonal planar shape, such as a rectangular, triangular or hexagonal shape, may also be used equally as a disk-shaped rotator.

Further, a rotator having a special shape, such as a cross-shaped rotator 36 as shown in FIG. 11, may also be used equally as a disk-shaped rotator. A cavity 11 is formed in the interior of the cross-shaped rotator 36, and a bubble injection hole 12 is formed near the end of each of the four arm portions 36*a* to 36*d*. It is also possible to provide a plurality of bubble injection holes 12 in each of the arm portions 36*a* to 36*d*.

Though the rotator of FIG. 11 has the structure of a cross-shaped combination of hollow rectangular members, it is also possible to employ a cross-shaped combination of tubular members. Further, it is possible to use a rotator having a plurality of arms radially extending from the rotating shaft.

Figure 12:
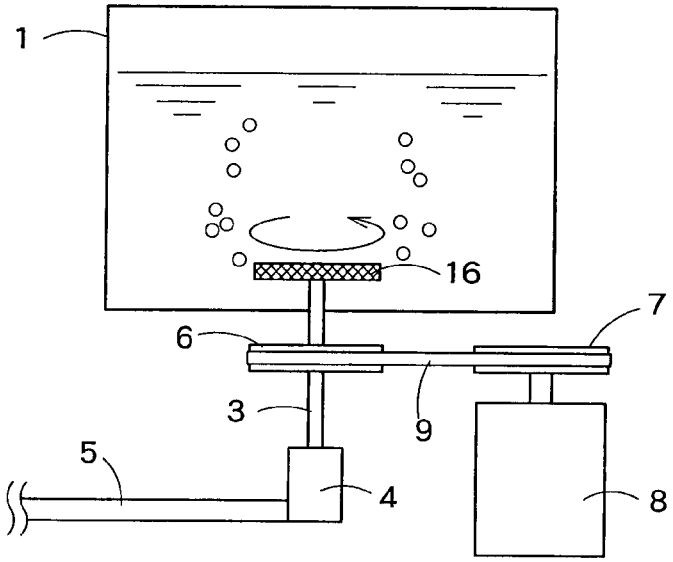
FIG. 12 is a diagram illustrating the construction of yet another microbubble generating apparatus according to the second embodiment of the present invention.

FIG. 12 shows yet another example of the bubble injection section 2 for use in the microbubble generating apparatus of FIG. 4.

The bubble injection section 2 shown in FIG. 12 is characterized by the use of a porous body 16 as a rotator constituting the bubble injection section 2.

The porous body 16 constituting the bubble injection section 2 is formed in a disk shape using a porous material having numerous fine pores.

The fine pores present in the structure of the porous body 16 serve as gas passages, and gas bubbles are injected into a liquid. The fine pores for passage of a gas can have a diameter on the order of several μm, which is much smaller than that of mechanically bored holes. The bubble injection section 2 comprised of the porous body 16 is therefore effective for generating fine gas bubbles.

<Third Embodiment>

Figure 13:
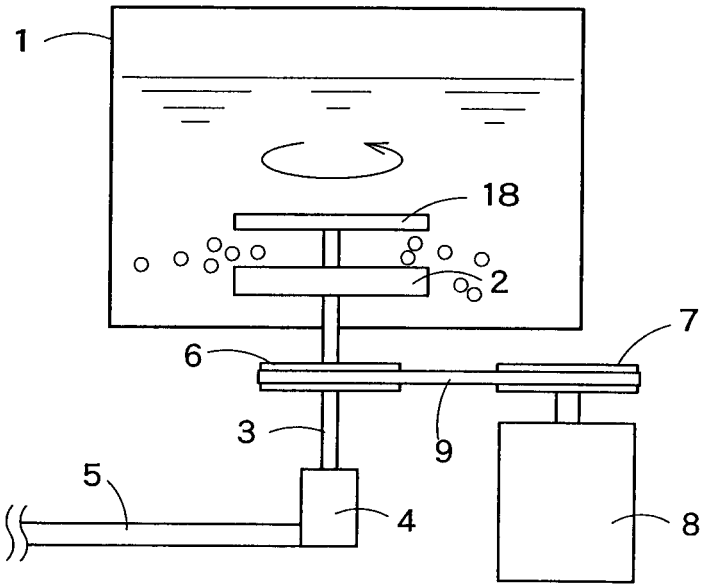
FIG. 13 is a diagram illustrating the construction of a microbubble generating apparatus according to a third embodiment of the present invention.

FIG. 13 shows a microbubble generating apparatus according to a third embodiment of the present invention.

The microbubble generating apparatus according to the third embodiment of the present invention adds a collision plate 18, provided above the bubble injection section 2, to the microbubble generating apparatus of FIG. 4.

The collision plate 18 is coaxially connected to the bubble injection section 2 and rotates in synchronization with the bubble injection section 2. The construction of the microbubble generating apparatus of this embodiment other than the collision plate 18 is the same as the microbubble generating apparatus of FIG. 4; the same components are given the same reference numerals and a detailed description thereof will be omitted. The bubble injection section 2 may be any of the above-described bubble injection sections 2 of FIGS. 4, 10, 11 and 12. This holds also for the below-described fourth to eighth embodiments.

In the microbubble generating apparatus of this embodiment, a shear force, produced by the relative movement between the bubble injection section 2 and the liquid, is applied to gas bubbles generated from the bubble injection section 2. The gas bubbles are torn apart by the shear force into gas bubbles having a smaller diameter. Thus, a first-stage bubble size reduction process takes place.

The gas bubbles then move upward and collide with the collision plate 18 rotating in synchronization with the bubble injection section 2. Upon the collision of the gas bubbles with the collision plate 18, a shear force is applied to the gas bubbles in the vicinity of the surface of the collision plate 18. Thus, a second-stage bubble size reduction process takes place.

Because the gas bubbles generated from the bubble injection section 2 are subjected to the first-stage and second-stage size reduction by the shear force applied, the production of finer gas bubbles becomes possible.

<Fourth Embodiment>

Figure 14:
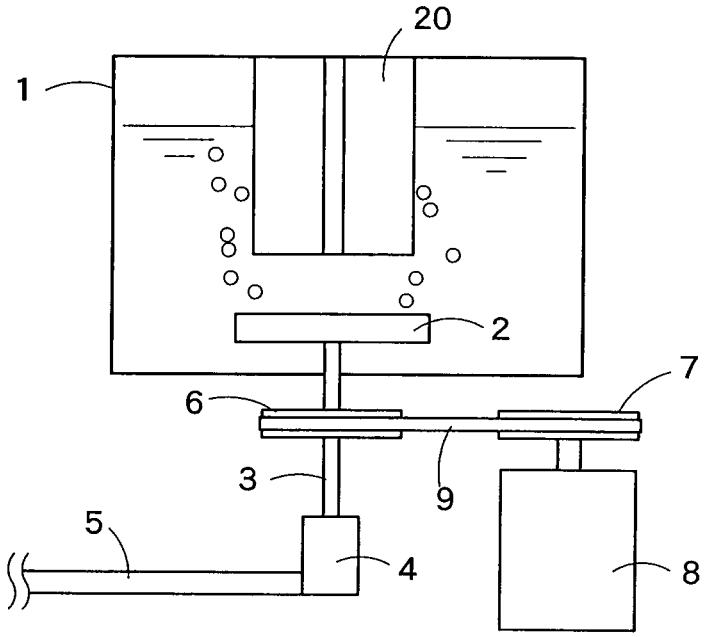
FIG. 14 is a diagram illustrating the construction of a microbubble generating apparatus according to a fourth embodiment of the present invention.

FIG. 14 shows a microbubble generating apparatus according to a fourth embodiment of the present invention.

In the fourth embodiment, a baffle plate 20 is provided instead of the collision plate 18 of FIG. 13. The baffle plate 20 is disposed coaxially above the bubble injection section 2. In this embodiment the baffle plate 20 has the shape of crossed plates, though various other shapes may be employed.

Gas bubbles generated from the rotating bubble injection section 2 are likely to gather and coalesce with one another above the center of the bubble injection section 2. Thus, gas bubbles, which have been torn apart by a shear force, tend to coalesce with one another and return to large bubbles. According to the microbubble generating apparatus having the baffle plate 20 provided above the bubble injection section 2, the baffle plate 20 can preclude gas bubbles from gathering above the center of the bubble injection section 2, thereby preventing coalescence of gas bubbles which have been torn apart by a shear force.

In addition, the cyclic flow produced by the rotation of the bubble injection section 2 can be changed by the presence of the baffle plate 20, making it possible to generate microbubbles more efficiently.

<Fifth Embodiment>

Figure 15:
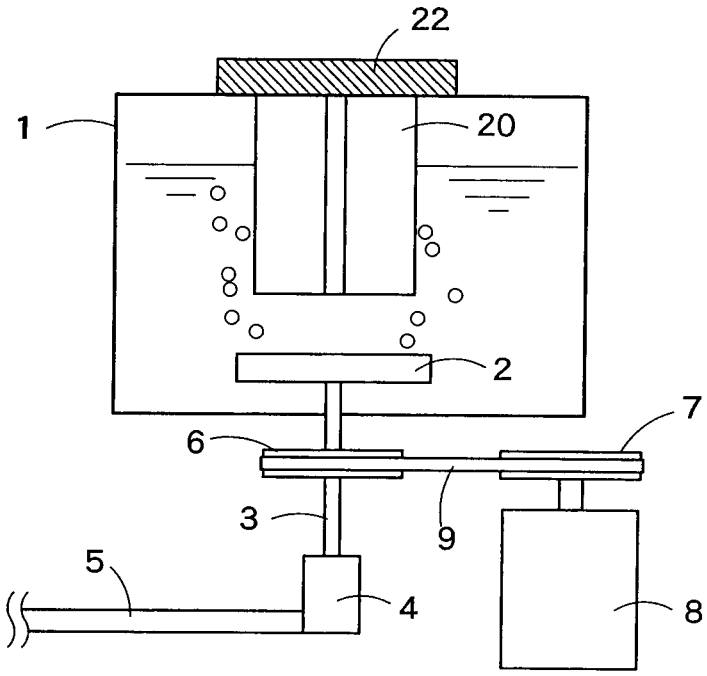
FIG. 15 is a diagram illustrating the construction of a microbubble generating apparatus according to a fifth embodiment of the present invention.

FIG. 15 shows a microbubble generating apparatus according to a fifth embodiment of the present invention.

In the fifth embodiment, in addition to the baffle plate 20 of FIG. 14, a vibration generator 22 for vibrating the baffle plate 20 is provided. The vibration generator 22 applies vibration, generated by a built-in oscillator, directly to the baffle plate 20.

According to this embodiment, as with the embodiment shown in FIG. 14, the baffle plate 20 can precludes gas bubbles from gathering above the center of the bubble injection section 2, thereby preventing coalescence of gas bubbles which have been torn apart by a shear force. In addition, because the baffle plate 20 is vibrating, gas bubbles can be prevented from adhering to the baffle plate 20 and, at the same time, coalesced gas bubbles can be again torn apart by the vibration. The microbubble generating apparatus can thus efficiently generate microbubbles.

<Sixth Embodiment>

Figure 16:
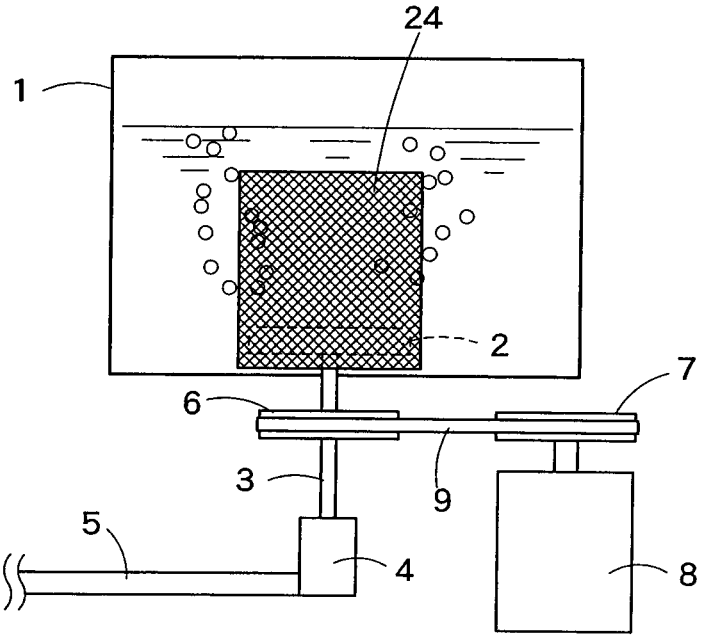
FIG. 16 is a diagram illustrating the construction of a microbubble generating apparatus according to a sixth embodiment of the present invention.

FIG. 16 shows a microbubble generating apparatus according to a sixth embodiment of the present invention.

In the microbubble generating apparatus shown in FIG. 16, the bubble injection section 2 is covered with a porous cover 24. The porous cover 24 is a cylindrical cover of porous material, whose top is closed.

According to this embodiment, gas bubbles, which have been generated from the rotating bubble injection section 2 and have become smaller by the action of a shear force, are discharged through the fine pores of the porous cover 24 to the outside of the cover. By covering the bubble injection section 2 with the porous cover 24, foreign matter that has entered the tank 1 can be prevented from coming into contact with the bubble injection section 2.

<Seventh Embodiment>

Figure 17:
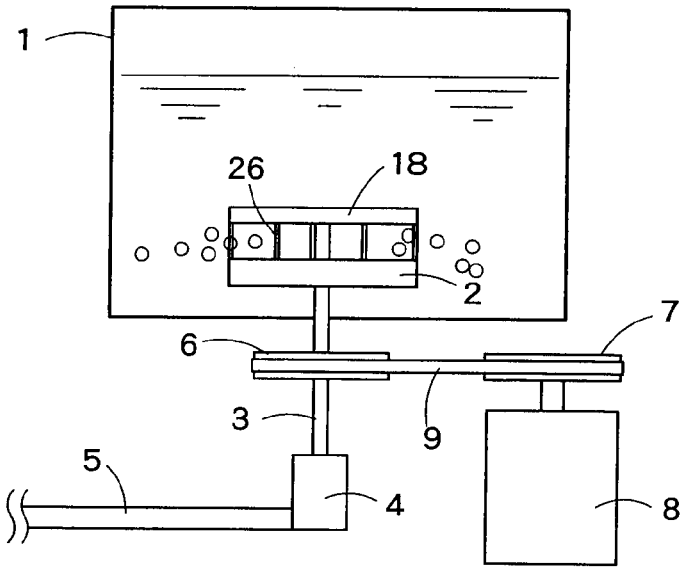
FIG. 17 is a diagram illustrating the construction of a microbubble generating apparatus according to a seventh embodiment of the present invention.

FIG. 17 shows a microbubble generating apparatus according to a seventh embodiment of the present invention.

In the microbubble generating apparatus shown in FIG. 17, a bubble breakup section 26 is provided between the collision plate 18 and the bubble injection section 2 of the microbubble generating apparatus shown in FIG. 13.

As shown in FIG. 17, the bubble breakup section 26 of this embodiment is comprised of a large number of narrow breakup plates arranged at regular intervals along the periphery of the bubble injection section 2.

As with the third embodiment, a first-stage bubble size reduction process takes place: A shear force, produced by the relative movement between the bubble injection section 2 and the liquid, is applied to gas bubbles generated from the bubble injection section 2, and the gas bubbles are torn apart by the shear force into gas bubbles having a smaller diameter. Further, a second-stage bubble size reduction process takes place: Upon the collision of the gas bubbles with the collision plate 18, a shear force is applied to the gas bubbles in the vicinity of the surface of the collision plate 18, whereby the gas bubbles are torn apart.

In this embodiment, an additional third-stage bubble size reduction process takes place: The gas bubbles, which have collided with the collision plate 18, flow toward the periphery of the plate, and the gas bubbles are then broken up by the bubble breakup section 26 into smaller bubbles. This embodiment thus enables further size reduction of gas bubbles.

<Eighth Embodiment>

Figure 18:
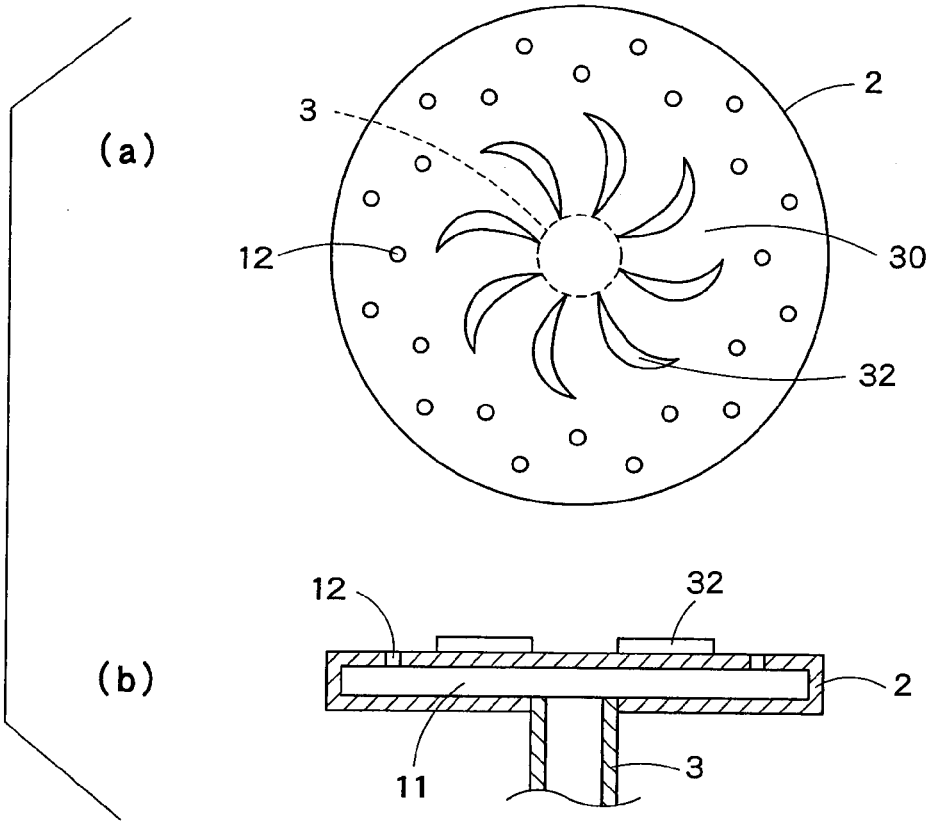
FIG. 18 shows a bubble injection section for use in a microbubble generating apparatus according to an eighth embodiment of the present invention, FIG. 18(*a*) being a plan view and FIG. 18(*b*) a cross-sectional view.

FIG. 18 shows a microbubble generating apparatus according to an eighth embodiment of the present invention.

On the bubble injection section 2 shown in FIG. 18, a plurality of vanes 32 are provided radially in a region where no gas injection hole 12 is formed.

In the bubble injection section 2 thus constructed, a flow of liquid flowing outwardly from the center is induced by the vanes 32 on the surface of the bubble injection section 2 when it is rotating. Release of gas bubbles from the bubble injection holes 12 can be promoted by the flow.

According to this embodiment, finer gas bubbles can be generated owing to the promoted release of gas bubbles from the bubble injection holes 12.

While the microbubble generating apparatus of the present invention has been described with reference to the first to eighth embodiments, the present invention is intended to cover any combination of the first to eighth embodiments.

The invention claimed is:

1. A microbubble generating method comprising:

supplying a gas to a rotator while rotating the rotator in a liquid;

injecting the gas into the liquid from bubble injection holes formed in a circular arrangement in the surface of the rotator; and applying a shear force, produced by the relative movement between the liquid and the rotator, to gas bubbles present on and in the vicinity of the surface of the rotator to generate microbubbles, wherein the bubble injection holes have a same diameter that is less than 1.00 mm and are arranged with a pitch interval greater than 10 mm, the bubble injection section is rotated such that a peripheral speed of the bubble injection holes of the rotator is not more than 6 m/s, and the gas is supplied to the bubble injection holes so that the gas is injected into the liquid through each bubble injection hole at a gas flow rate of less than 0.25 liter/min.

2. The microbubble generating method according to claim 1, wherein the rotating speed of the rotator is varied in the range of not more than 6 m/s in terms of the peripheral speed of the bubble injection holes of the rotator in order to adjust the diameters of the gas bubbles generated.

3. The microbubble generating method according to claim 2, wherein the rotator having an increased number of the bubble injection holes is used to increase the limit value of gas flow rate while maintaining a small bubble diameter.

* * * * *